United States Patent [19]

Fuller

[11] Patent Number: 4,908,617

[45] Date of Patent: Mar. 13, 1990

[54] PARKING STALL MONITOR

[75] Inventor: Kip L. Fuller, Denver, Colo.

[73] Assignee: Innovision Technologies Group, Inc., Denver, Colo.

[21] Appl. No.: 192,346

[22] Filed: May 10, 1988

[51] Int. Cl.[4] ..... G08G 1/14

[52] U.S. Cl. ..... 340/932.2; 368/90

[58] Field of Search ..... 340/51, 943, 932.2; 364/464.01, 467; 194/900, 902; 368/90, 92; 49/49

[56] References Cited

U.S. PATENT DOCUMENTS

| | | | |
|---|---|---|---|
| Re. 20,764 | 6/1938 | Babson | 340/51 |
| 3,015,087 | 12/1961 | O'Gorman . | |
| 3,045,909 | 7/1962 | Auer Jr. | 340/51 X |
| 3,376,547 | 4/1968 | Auer Jr. | 340/51 |
| 3,440,633 | 4/1969 | Vinding . | |
| 3,849,936 | 11/1974 | Geraci . | |
| 4,095,739 | 6/1978 | Fox et al. . | |
| 4,310,890 | 1/1982 | Trehn et al. | 340/51 X |
| 4,356,903 | 11/1982 | Lemelson et al. | 340/51 X |
| 4,713,910 | 12/1987 | Quante . | |

*Primary Examiner*—Joseph A. Orsino
*Assistant Examiner*—Brian R. Tumm
*Attorney, Agent, or Firm*—Wood, Herron & Evans

[57] ABSTRACT

A parking stall monitor located adjacent a restricted use parking stall periodically transmits a burst of ultrasonic pulses into the parking stall during a first time interval and then periodically detects the reflection of the ultrasonic pulses off of a vehicle in the parking stall during a second time interval, the first and second time intervals being staggered in time. Upon detecting vehicle presence in the stall, the monitor provides an audible warning to indicate that use of the stall is restricted. Before and after authorized use of the stall, the monitor can be selectively disarmed and then rearmed, respectively, by a signal transmitted from a portable transmitter within the authorized vehicle.

21 Claims, 8 Drawing Sheets

PARKING STALL MONITOR

FIELD OF THE INVENTION

This invention relates to a parking stall monitor which provides an audible warning upon detecting the unauthorized presence of a vehicle in a reserved parking stall.

BACKGROUND OF THE INVENTION

It is common to designate certain particularly convenient parking locations or stalls for a designated individual, i.e., a president of a company, or a select group of individuals, i.e., handicapped individuals. Such designation can be accomplished by a written notice, constituting either an upright sign or indicia printed in or adjacent the parking stall. However, absent costly around-the-clock human surveillance, a printed notice of restricted use seldom sufficiently deters all unrestricted uses of a parking stall.

Prior attempts to control access to a restricted use parking stall have included the use of a retractable barrier which is remotely controlled by either a radio or a coin operated device accessible to the driver of the vehicle to retract the barrier upon contact of the barrier by a wheel of the vehicle. Absent the proper signal, the barrier will block entry of a vehicle into the stall.

Such devices are bulky and cumbersome, requiring the erecting and maintaining, of a retractable physical structure within the parking stall. In addition to the cost of installation, barrier monitors introduce an inconvenience with respect to maintaining an entire parking lot. For example, during a snow emergency, a plow is physically restricted from laterally traversing and clearing a large number of stalls in a short period of time.

It is therefore desirable to provide a cost-effective parking stall monitor which effectively prevents unauthorized use of a parking stall, yet does not require the erection and maintenance of a barrier within the stall.

SUMMARY OF THE INVENTION

To these ends, according to a preferred embodiment of this invention, a parking stall monitor comprises a housing located adjacent a restricted use parking stall with a clock circuit, a vehicle presence sensing circuit, an arm/disarm circuit and an alarm circuit mounted within the housing. The clock circuit controls the vehicle sensing circuit to transmit energy in the form of a short burst of ultrasonic pulses in the direction of the parking stall, and then after a predetermined time interval, to detect during a time window of predetermined duration the reflection of the transmitted energy off of a vehicle located in the stall. Upon detecting the presence of a vehicle within the stall, the vehicle presence sensing circuit keys the clock circuit, which signals the alarm circuit. The alarm circuit provides an audible warning, preferably a verbal warning, that use of the stall is unauthorized and the vehicle will be towed if not removed from the stall.

The arm/disarm circuit is operatively connected with at least one of the clock circuit, the vehicle presence sensing circuit and the alarm circuit, and is responsive to an encoded RF signal transmitted from a portable transmitter in an authorized vehicle to either arm or disarm the monitor. Thus a driver of an authorized vehicle is able to disarm the monitor when parking an authorized vehicle in the stall, and to arm the monitor when leaving the stall. Preferably, receipt of a disarm signal is indicated by a red indicating light mounted on the housing, and receipt of an arm signal is indicated by a green indicating light on the housing.

The audible warning can vary according to preference. In one embodiment of this invention, the monitor is programmable to allow an authorized user to select a desired alarm sequence, including a desired verbal warning.

If desired, the alarm circuit can also transmit a warning signal in the form of an RF signal to a central location such as a secretary's office, in order to provide immediate notification of unauthorized use. Alternatively, at the central location, the reception of the signal can be used to activate an automatic dial telephone line to summon a tow truck. For this modification, the signal transmitted to the central location would preferably be coded to correspond to a particular parking stall.

The parking monitor of this invention provides effective, unsupervised monitoring of a restricted use parking stall, while alleviating the need to construct and maintain a barrier in the stall to physically block unauthorized access to the stall.

DETAILED DESCRIPTION OF THE DRAWINGS

Figure 1:
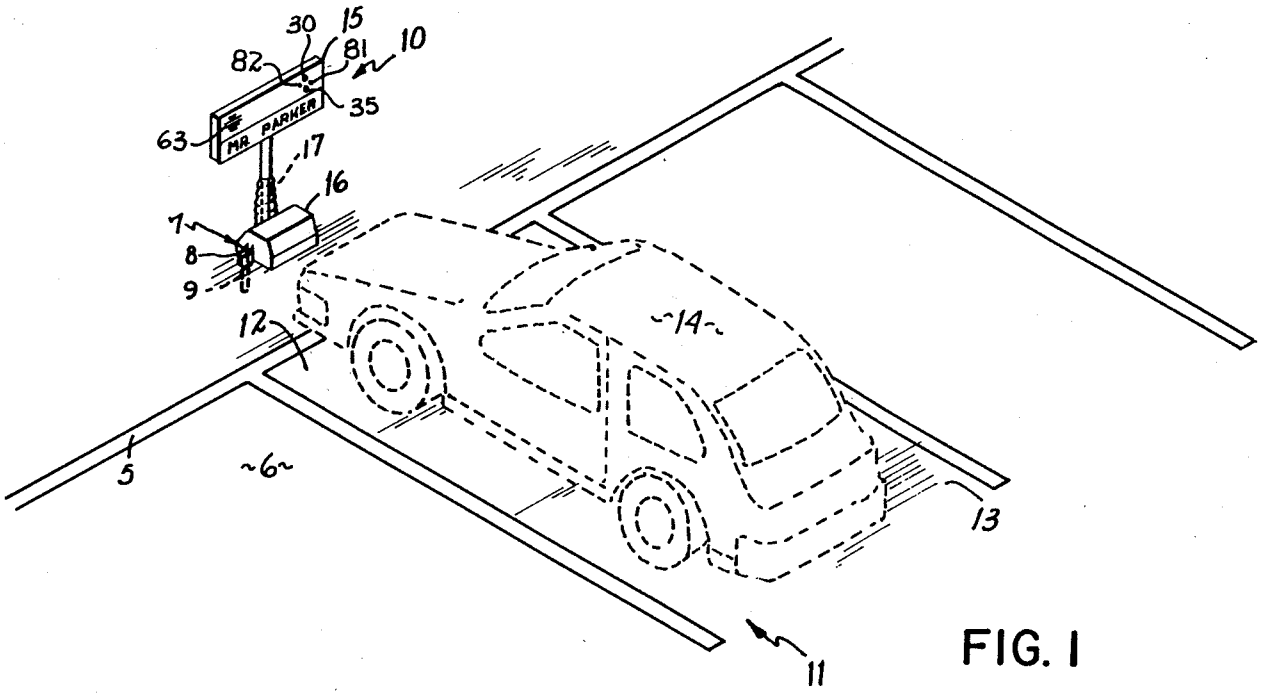
FIG. 1 is a perspective view, of a parking lot with a preferred embodiment of the parking stall monitor of this invention mounted adjacent a restricted use parking stall.

According to a preferred embodiment of the invention, as shown in FIG. 1, a parking stall monitor 10 is located outside of, but adjacent a restricted use parking stall 11 which is delineated by painted borders 5 on a parking surface 6. The monitor 10 resides adjacent a first end 12 of the stall 11, which lies opposite, and is spaced from, a second end 13 that is used for entry and exit of a vehicle 14. Preferably, the parking monitor 10 comprises a housing 15 flexibly mounted to a base 16 by a hollow, yieldable assembly 17.

In a preferred embodiment, a surface of the housing 15 facing the stall 11 bears some indicia, i.e., a name or a warning, to indicate restricted use of the stall 11. The yieldable assembly 17 includes a spring to provide some degree of flexibility between the housing 15 and the base 16 in order to minimize damage in the event that the vehicle 14 strikes the monitor 10. The base 16 carries a captive female threaded tamper resistant fastener 7 on an ear 8 projecting from each side thereof. Each captive fastener 7 engages a threaded portion of a respective exteriorly threaded stud 9 embedded within and projecting a sufficient distance above the parking surface 6. The housing 15 contains most of the circuitry for the monitor 10 while the base 16 preferably houses the power supply, thus providing ground support for most of the weight of the monitor and increasing overall stability. The power supply preferably comprises two 6-volt lantern batteries. Two Eveready alkaline batteries sold as Part No. NEDA908A have proved suitable.

Figure 2:
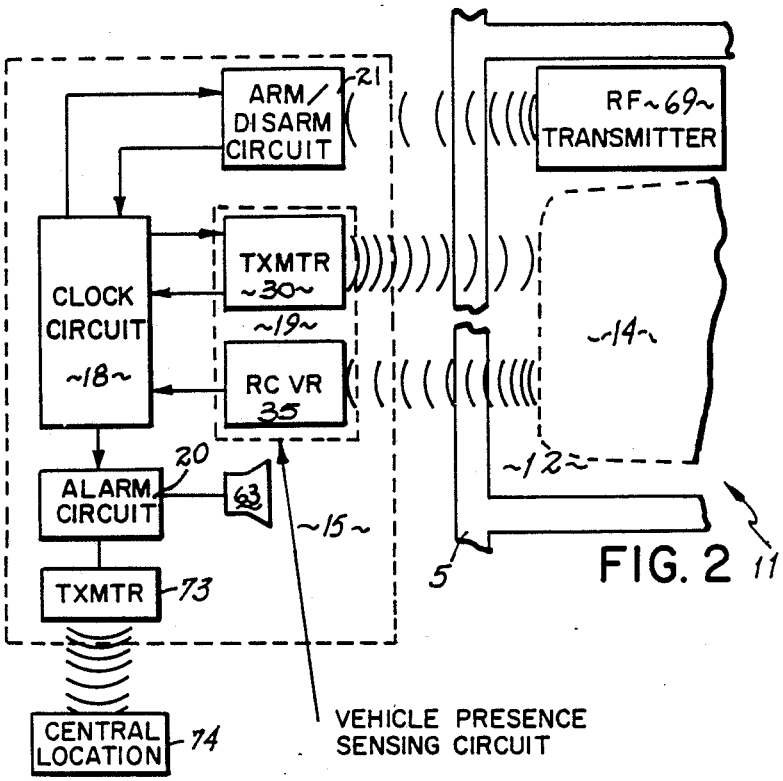
FIG. 2 is a block diagram which illustrates the operation of a parking stall monitor according to a preferred embodiment of this invention.
Figure 4:
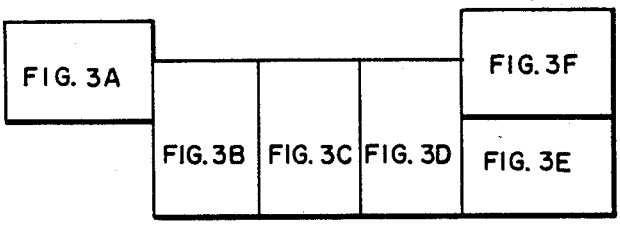
FIG. 4 shows the relative positioning of FIGS. 3A–3F necessary to provide an entire circuit schematic of a parking stall monitor according to a preferred embodiment of the invention.

According to a preferred embodiment of the invention, and shown in block form in FIGS. 2 and schematically in FIGS. 3A–3F, a clock circuit 18, a vehicle sensing circuit 19, an alarm circuit 20 and an arm/disarm circuit 21 reside within housing 15.

Figure 3A:
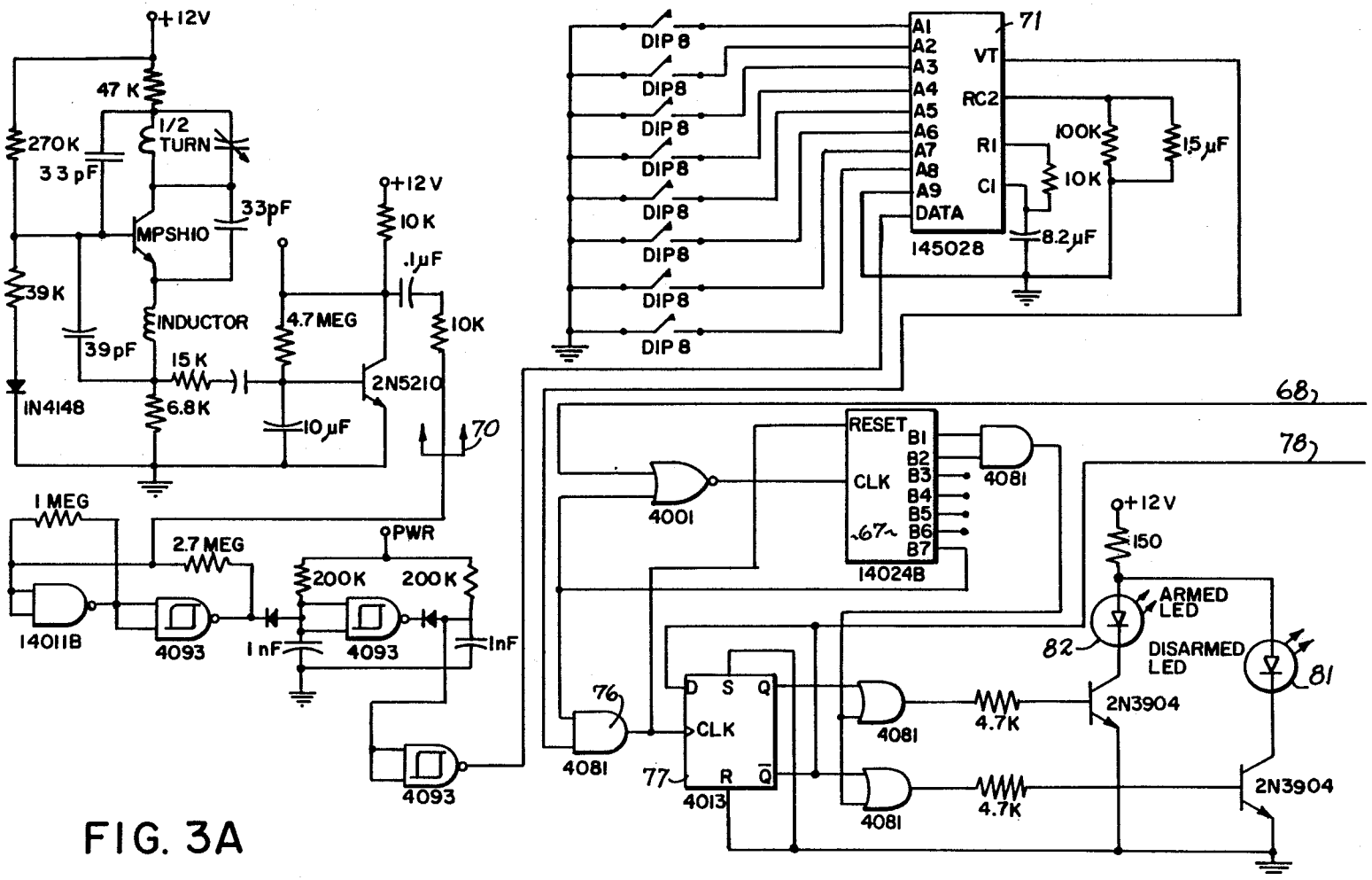
FIGS. 3A–3F show circuit schematics for the clock circuit, the vehicle presence sensing circuit, the alarm circuit and the arm/disarm circuit according to a preferred embodiment of the invention.
Figure 3B:
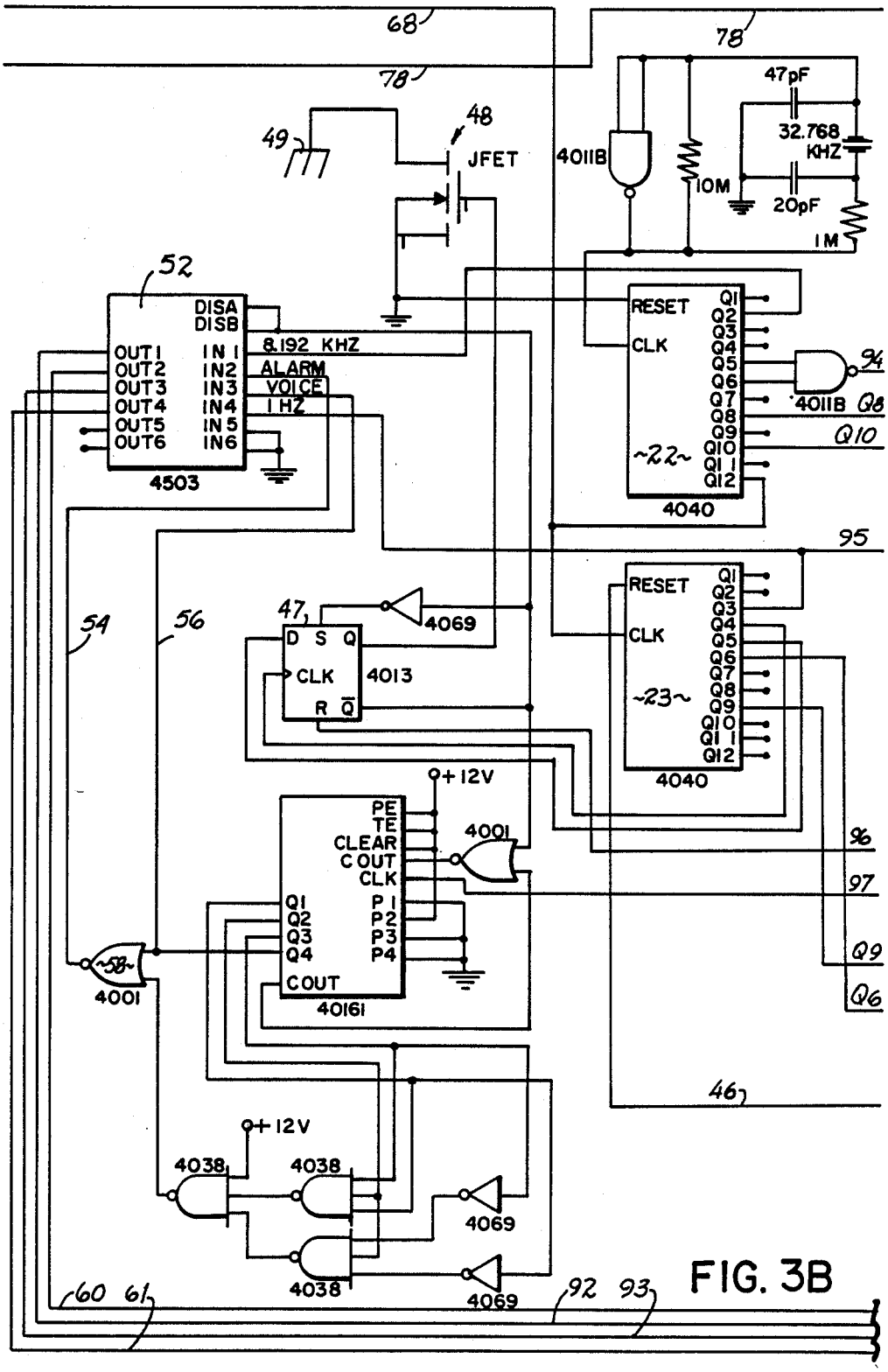
Figure 3C:
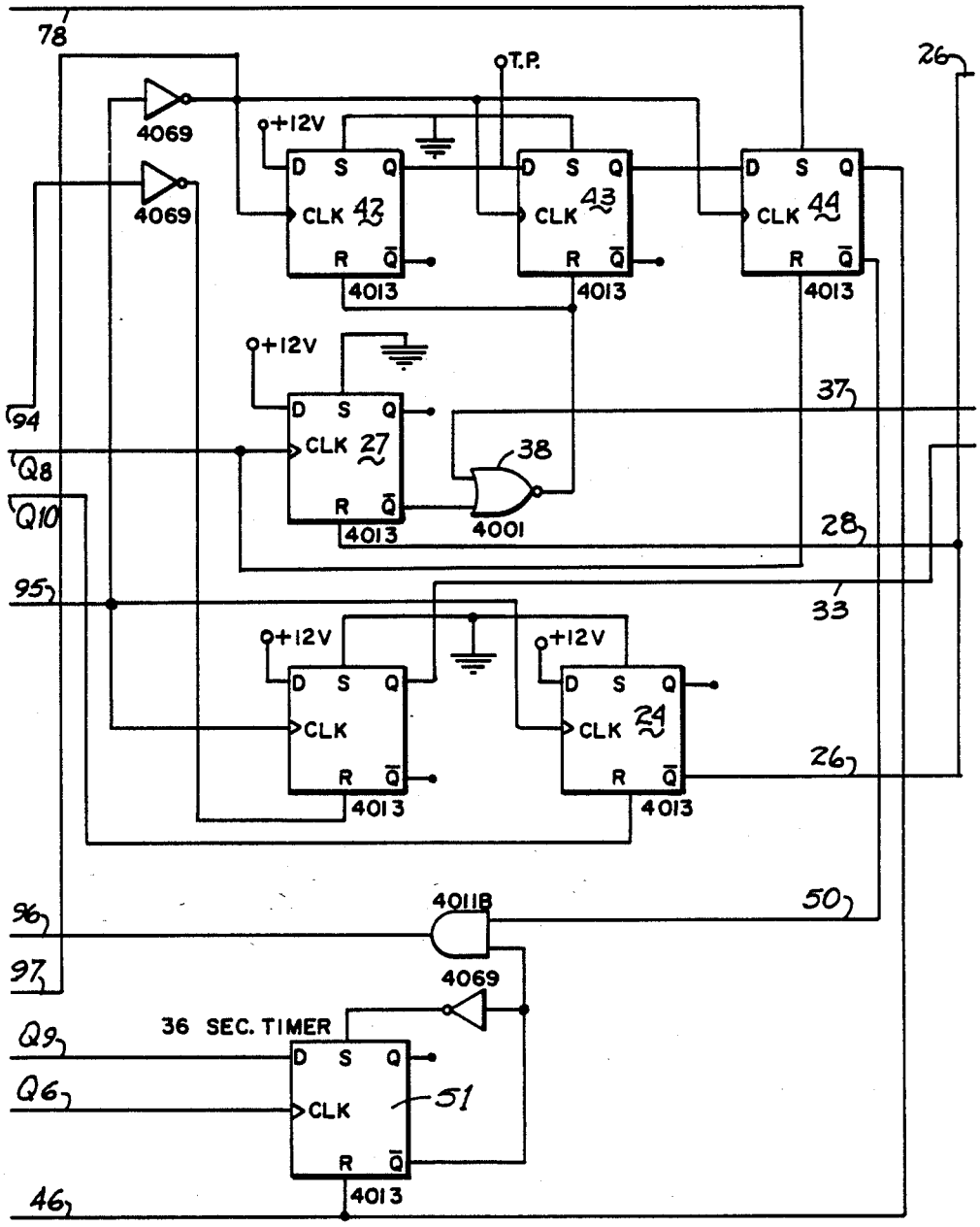
Figure 3D:
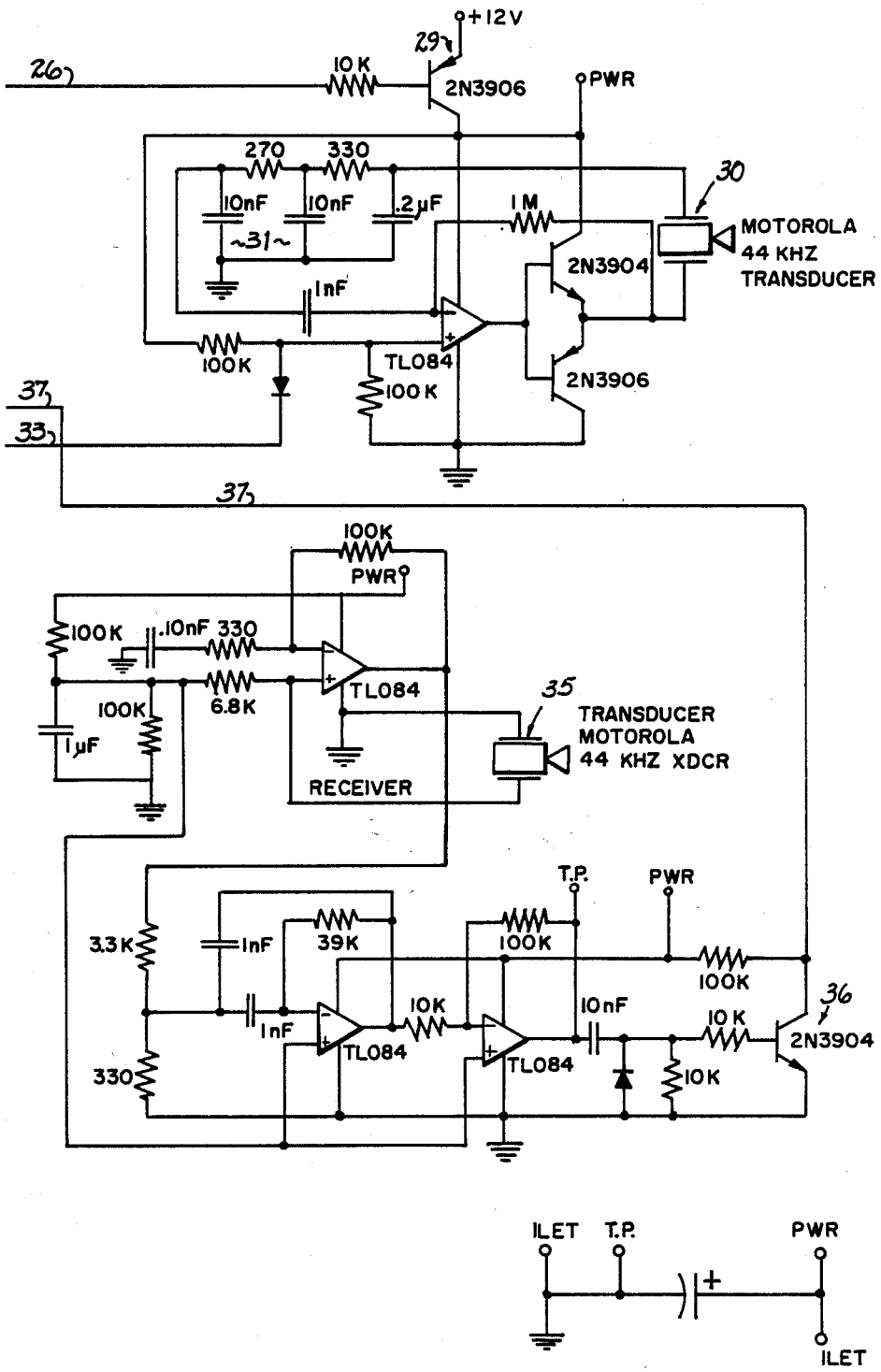

The clock circuit 18 provides all of the timing signals which control the sequences of operation for the other circuits. As shown in FIG. 3B, the output of a 32.768KHz crystal oscillator is input into time divider 22, and into time divider 23 via time divider 22 to provide the time base for the clock circuit 18. Each of the time dividers has outputs numbered Q1 through Q12. The output of Q1 is at a frequency which is halved from the CLK input, and each of the numbered outputs provides a signal which is halved with respect to the next adjacent output above it.

In one preferred sequence of operation, the sequence programmed to repeat every second, a signal from a flip flop 24 (FIG. 3C) within the clock circuit 18 over line 26 turns on a transistor 29 (FIG. 3D) in the vehicle sensing circuit 19 to provide power to a transmitter 30 and the rest of the presence sensing circuit 19 via the PWR connection. The signal from flip flop 24 also resets another flip flop 27 (FIG. 3C) via line 28 at the same time that transistor 30 is turned on.

While transistor 29 is on, transmitter 30 transmits ultrasonic signals into the stall 11 which are created by an oscillating circuit 31 at about 44KHz. After a first time interval of about 1.5 milliseconds, a signal from the clock circuit 18 to the vehicle sensing circuit 19 over line 33 turns off the transmitter 29. Because the transmitting circuitry takes about 0.8 milliseconds to warm up, the burst of audio pulses lasts about 0.7 milliseconds.

The vehicle sensing circuit 19 is keyed by the clock to look for these reflected pulses during a second time interval, which is a time window of predetermined duration staggered in time after the first interval. Staggering of the first and second time intervals assures that no interference will occur as a result of simultaneous transmitting and receiving. The duration of time stagger between the first and second intervals is chosen to correspond to a sound wave traveling a maximum of 6 feet into the parking stall and 6 feet back towards the housing. The time stagger and the second time interval are timed such that reflected pulses will not be detected off of a vehicle in an area outlying the stall.

A receiver 35 (FIG. 3D) senses any of the ultrasonic pulses that are reflected back toward the housing 11 from an object within the stall. Reception of reflected signals by receiver 35 will cause the output of transistor 36 to go low, providing a low signal over line 37 to one input of a NOR gate 38 in the monitor. The other input of the NOR gate 38, connected to the $\overline{Q}$ output of flip flop 27, goes low about 3.9 milliseconds after the transistor 29 is initially turned on.

Thus, reflected signals are sensed during a time window which begins about 3.9 milliseconds after initial powering of the sensing circuit 19, with about a 2.4 millisecond delay between the end of pulsed ultrasonic transmission and the sensing of reflected pulses. Sensing of reflected signals is possible so long as flip flop 27 remains low, which will be for a duration of about 11.7 milliseconds, or until about 15.6 milliseconds have elapsed from the time of first turning on transistor 29. This is sufficient time for a sound wave to travel into the stall reflect off of an object within the stall, and return to the housing.

If no pulses are received at gate 38, flip flops 42 and 43 are not reset, and flip flop 44, connected to the Q output of flip flop 43, will periodically reset the time divider 23 via a signal from its Q output over line 46. The time divider 23 will be reset by flip flop 44 at a frequency such that a flip flop 47 (FIG. 3B) connected to Q4 and Q5 of time divider 23, never activates the alarm circuit 20.

With both inputs to NOR gate 38 low, two flip flops, 42 and 43, respectively, are reset. When flip flops 42 and 43 are reset, and the Q output of flip flop 43 fed into flip flop 44, the $\overline{Q}$ output of flip flop 44 will go high, transmitting a signal over line 50 which will eventually activate the alarm circuit 20. In the absence of a reset signal over line 46, the clock circuit 18 activates the alarm circuit 20 via outputs Q4 and Q5 from time divider 23. Outputs Q4 and Q5 are fed into flip flop 47 which turns on a JFET 48 to ground a floating ground 49. The components of the alarm circuit 20, for the most part shown in FIGS. 3E and 3F, become operative when the floating ground 49 is pulled low. JFET 48 remains on for a duration 36 seconds, set by timer 51, so long as the $\overline{Q}$ output of flip flop 44 remains high.

According to the alarm sequence depicted in FIGS. 3A–3F, after the alarm circuit has been activated, the clock 18 provides a four second delay, followed by a four second audible siren, followed by a one second delay which is then followed by an eight second verbal message such as "warning, move your car or it will be towed." After a one second delay, the sequence picks up at the four second siren to repeat one more time before ending with another one second delay followed by a four second siren.

Figure 3E:
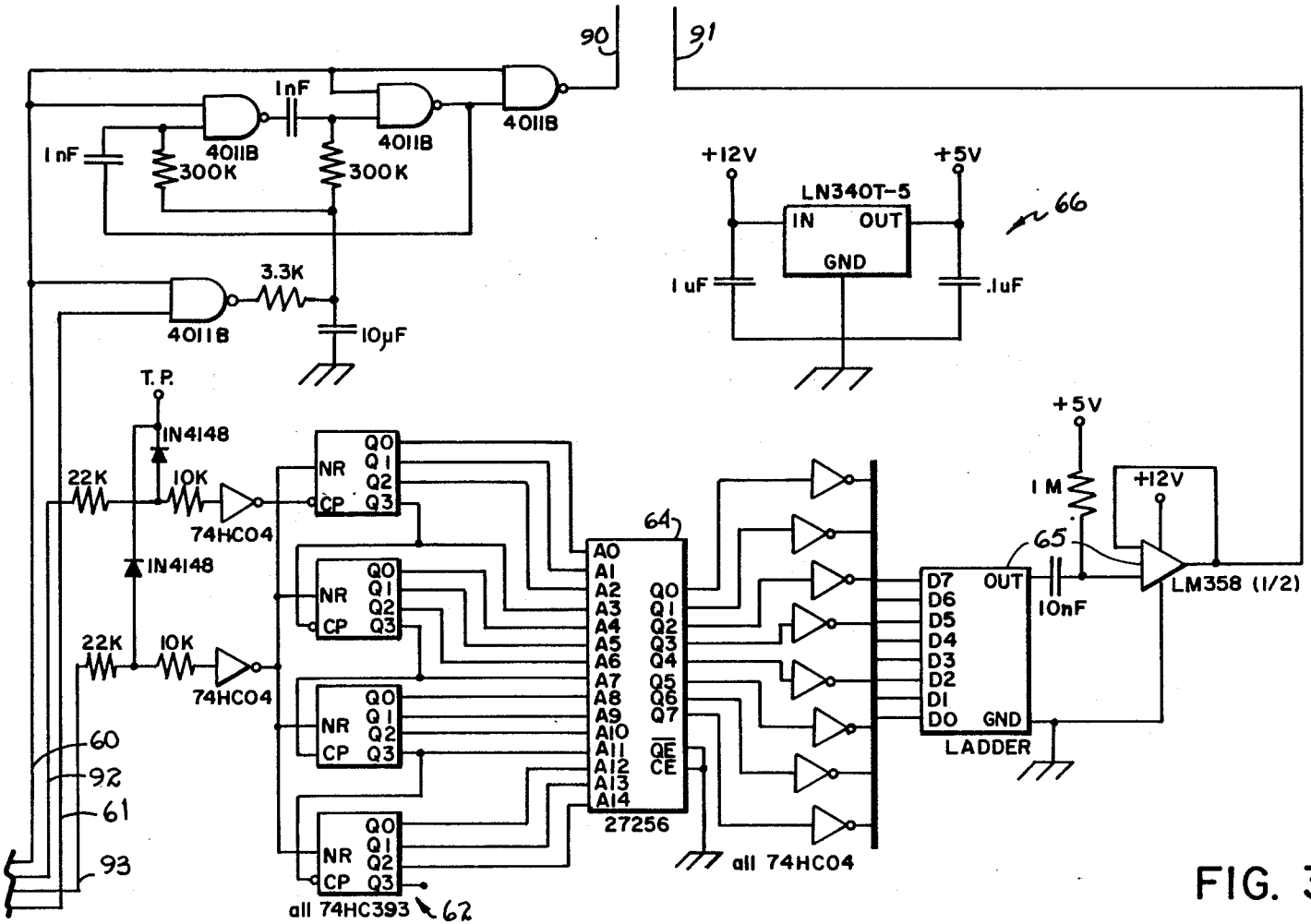
Figure 3F:
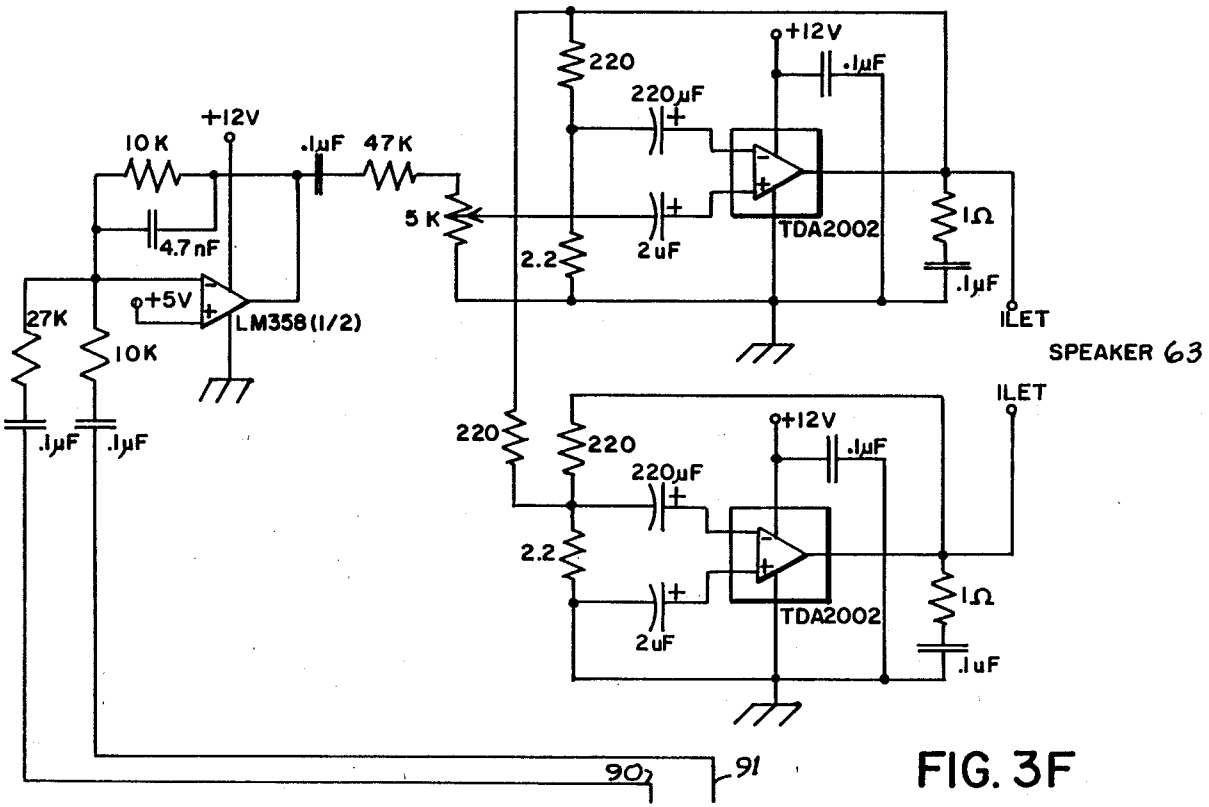

The signal to activate non-verbal audible warning is carried over line 54 into a buffer 52. A signal on line 56, which activates the verbal warning circuitry, disables the non-verbal alarm signal on line 54 via NOR gate 58, thus preventing simultaneous verbal and non-verbal warnings. Signals over lines 61 and 60 out of buffer 52 activate the circuitry (shown in FIG. 3E) for providing verbal and non-verbal warnings, respectively, which are amplified and eventually emitted through a speaker 63 (FIG. 3F). Interruption of the "vehicle presence sensed" signal prior to the siren will cause the clock circuit 18 to disable the alarm circuit 20 via a signal on line 50.

The verbal warning is provided by a PROM 64 which provides an output to a digital-to-analog converter 65 that is input to the speaker 63. The PROM 64 may store multiple messages which are selectable by the operator. Alternatively, interchangeable PROMs 64 could be used to enable greater variation in selection of an appropriate message. If desired, one or more additional message storage devices may be added to or used to replace the PROM 64 verbal warning circuit so that an authorized user may record, and later select, one or more of his or her own personalized verbal messages. A voltage regulator 66, shown in FIG. 3E, provides an operating voltage of 5 volts d.c., for all the components of the monitor 10, except those otherwise marked as +12V or PWR.

The arm/disarm circuit 21 enables authorized use of the parking stall without setting off the alarm. A timer 67 in the arm/disarm circuit 21 is keyed by the Q12 output of time divider 22 via line 68 to look for a signal from a hand held transmitter 69 carried by an authorized user. Similar to a hand held device used to operate an electronic garage door opener/closer, the hand held transmitter 69 transmits an encoded RF signal to activate or deactivate the arm/disarm circuit 21. If the parking monitor 10 is armed, an encoded RF signal from the transmitter is received by a receiver circuit shown above directional arrows 70, decoded by a decoder 71 and fed into an AND gate 76 which is connected to the B7 output of timer 67. The receiver is tuned to a carrier frequency of about 300 MHz.

When a pulsed signal from timer 67 is received, assuming the monitor is "armed", the high $\overline{Q}$ output from flip flop 77 is transmitted via line 78 to hold the Q output of flip flop 44 in a high state, thus preventing the clock 18 from keying the alarm 20 and "disarming" the monitor. The $\overline{Q}$ output of flip flop 77 also turns on a red light emitting diode 81 to indicate the disarmed condition.

Similarly, the next encoded RF signal transmitted by the transmitter 69 to the arm/disarm circuit 21 will cause the $\overline{Q}$ output of flip flop 77 to go low. The low signal transmitted over line 78 will enable the Q output of flip flop 44 to go low, thus "rearming" the monitor. The Q output of flip flop 77 will activate a green light emitting diode 82 to indicate the rearmed condition. To save power, the respective light emitting diodes will blink for a duration of about eight seconds whereupon a signal from timer 67 will turn them off.

The integrity of the monitoring system is assured by the use of encoded transmitted RF signals to change the state of the arm/disarm circuit 21. The transmitter 69 is coded according to an eight bit binary number to transmit a series of either long or short pulses on a carrier of about 300 MHz. The arm/disarm circuit 21 is set to decode only an eight bit series of pulses corresponding in duration to those transmitted from a similarly coded transmitter 69. As mentioned previously, and as depicted in FIG. 2, a warning signal can be transmitted from a transmitter 73 located at the monitor 10 to a remotely located central location 74.

While in the preferred embodiment the invention has been described in connection with a self-contained unit containing the transmitter, the receiver, the alarm and the warning sign, which is located exteriorly of the parking space adjacent the forward end where the leading end of the vehicle is typically located, other variations coming within the spirit and scope of the invention are possible. For example, the self-contained monitor with warning sign, vehicle sensor and alarm could be located on the boundary line between adjacent parking spaces disposed opposite either the passenger or the driver's door. If this approach were utilized, the transmitter would be directing energy transversely across the parking stall, whereas in the preferred embodiment the energy transmitted is in a direction lengthwise of the parking stall.

In accordance with a further possible variation the presence detector could take the form of an inductive loop embedded in the ground within the parking stall. The inductive loop would be connected to a sensor located in the monitor at a point outside the parking stall adjacent the position the front end of a vehicle occupies when parked in the stall, such as shown in FIG. 1, or in a monitor located on the boundary between adjacent stalls as described immediately above.

In addition to an inductive coil, a mechanical tredle switch located on the ground at the entry/exit end of the parking stall could also be provided. As a further alternative to the inductive coil and tredle switch, an energy transmitter embedded in the ground in the parking stall and directing energy vertically upwardly in combination with an energy sensor for receiving energy reflected downwardly from the bottom of the car could be provided.

Finally, and as a still further alternative vehicle sensing means, vertical posts could be provided on the boundaries between adjacent parking stalls. In accordance with this arrangement, for each parking stall, the post on one side thereof would be provided with an energy transmitter directed transversely across the stall and on the post associated with the other side of the stall an energy receiver would be provided for receiving transmitted energy. Upon entry of an automobile into the parking space the beam of energy transversely directed across the parking stall from one post to the other would be interrupted, indicating the presence of a vehicle.

Figure 5:
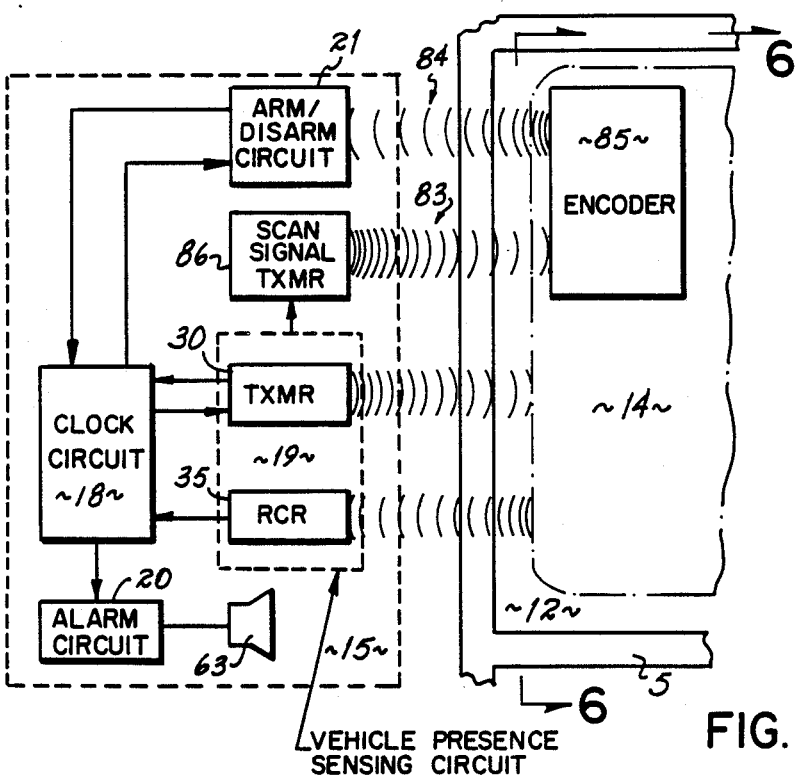
FIG. 5 is a block diagram which illustrates the operation of a parking stall monitor in accordance with an alternative embodiment of the invention, the alternative embodiment involving automatic means for arming and disarming the monitor.

While the present invention has been described with respect to an arm/disarm circuit 21 which is manually operable by the driver of an authorized vehicle, other variations within the spirit and scope of the present invention enable the arm/disarm function to be carried out automatically, either actively or passively. In an active automatic arm/disarm system, as shown in FIG. 5, in response to a scan signal 83 sent into the stall by the monitor upon detecting vehicle 14 presence in the stall 5, an authorized vehicle transmits an encoded signal 84 which is received and recognized by the monitor to disable the alarm during authorized parking. The system is referred to as "active" because the authorized vehicle must transmit for the duration of authorized use. Signal 84 is automatically transmitted by encoder 85 upon receipt of signal 83.

Figure 6:
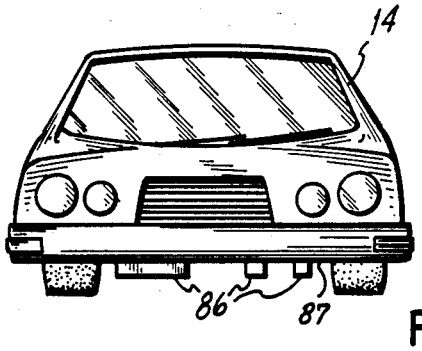
FIG. 6 is a cross-sectional view taken along lines 6—6 of FIG. 5, showing a modification of the vehicle 14 to accommodate passive automatic arming and disarming of the monitor.

In a passive automatic system, an actively transmitting encoder 85 is not required after detecting vehicle presence the monitor transmits a scan signal 83 into the stall which, upon recognizing a coded structural configuration of the car, i.e., a plurality of reflectors 86 extending from the bottom 87 of the chassis of the vehicle and spaced according to a predetermined, coded pattern, as shown in FIG. 6, the warning and alarm circuitry is inhibited. Thus, an authorized vehicle will not set off the alarm while it is in the stall. This system is referred to as "passive" because the authorized vehicle does not transmit anything but only reflects a predetermined code. In both the active and the passive automatic systems, the warning signal inhibiting mechanism is at least partially carried by the authorized vehicle.

While the above description constitutes a preferred embodiment of the parking stall monitor of this invention, it is to be understood that the invention is not limited thereby and that in light of the present disclosure of the invention, various other alternative embodiments will be apparent to a person skilled in the art. Accordingly, it is to be understood that changes may be made without departing from the scope of the invention as particularly set and claimed.

I claim:

1. A parking stall monitor for indicating unauthorized use of a parking stall comprising:

means for detecting the presence of a vehicle in said parking stall and for providing a warning signal upon detecting said vehicle presence; and means for selective disarming and arming of said means for detecting presence and providing a warning signal, thereby to enable an authorized vehicle to occupy said parking stall without said warning signal being provided, said selective arming and disarming means including a transmitter adapted to transmit an encoded signal and a receiver adapted to receive said encoded signal from said transmitter and in response thereto, to provide an arm/disarm signal to said presence detecting means.

2. The parking stall monitor of claim 1 wherein said means for detecting presence and providing a warning signal is adapted to detect the presence of a vehicle in said parking stall but not in an area outlying said stall.

3. The parking stall monitor of claim 1 wherein said means for detecting presence and providing a warning signal further comprises:

means for transmitting a first signal in the direction of said parking stall;

means for receiving a reflection of said first signal from a vehicle in said parking stall.

4. The parking stall monitor of claim 3 wherein said means for detecting presence and providing a warning signal further comprises:

clock means in operative relationship with said transmitting means and said receiving means to enable transmittal of said first signal during a first time interval and reception of said reflected signal during a second time interval, said first and second time intervals being spaced in time by a predetermined time interval.

5. The parking stall monitor of claim 3 wherein said first signal comprises a plurality of pulsed signals.

6. The parking stall monitor of claim 5 wherein said pulsed signals are ultrasonic signals.

7. The parking monitor of claim 6 wherein said pulsed ultrasonic signals have a frequency of about 44 KHz.

8. The parking stall monitor of claim 1 and further comprising:

means for indicating when said monitor is disarmed and when said monitor is armed.

9. The parking stall monitor of claim 8 wherein said indicating means further comprises:

a first light to indicate an armed condition; and a second light to indicate a disarmed condition.

10. The parking stall monitor of claim 1 wherein said means for selective disarming and arming further comprises:

a housing located outside of said stall, said means for detecting presence and providing a warning signal being mounted to said housing.

11. The parking stall monitor of claim 1 wherein said warning signal comprises an audible alarm.

12. The parking stall monitor of claim 11 wherein said audible alarm comprises alternate verbal and non-verbal warnings.

13. The parking stall monitor of claim 1 wherein said warning signal includes a selectively programmed verbal warning.

14. The parking stall monitor of claim 1 wherein said warning signal is communicated to a central location.

15. The parking stall monitor of claim 1 and further comprising:

a housing for mounting at least a portion of said means for detecting and providing a warning signal and said means for selective arming and disarming, said housing located adjacent said parking stall.

16. The parking stall monitor of claim 15 wherein said housing is permanently secured adjacent said parking stall and includes a sign bearing warning indicia that use of said parking stall is restricted, said sign being mounted for yielding movement with respect to said parking stall to minimize damage with respect thereto in the event struck by a vehicle.

17. A parking stall monitor for indicating unauthorized use of a parking stall comprising:

a clock;

a vehicle presence sensing means operatively associated with said clock to detect the presence of a vehicle in said parking stall during a time window of predetermined duration, said presence sensing means being periodically enabled for successive said time windows by said clock;

an alarm means operatively associated with said vehicle sensing means to provide an audible warning upon the detection of a vehicle in said parking stall during said time window;

means for selective disarming and arming of at least one of said clock, said vehicle presence sensing means and said alarm means to enable an authorized vehicle to occupy said parking stall without generating said audible warning, said selective arming and disarming means including a transmitter adapted to transmit an encoded signal and a receiver adapted to receive said encoded signal from said transmitter and in response thereto, to provide an arm/disarm signal to said presence detecting means.

18. A parking stall monitor for indicating unauthorized use of a parking stall comprising:

a clock;

transmitting means operatively associated with said clock to periodically transmit a first burst of pulses in the direction of said stall during a first time interval;

receiving means operatively associated with said clock to periodically detect during a second time interval said burst of pulses after being reflected off of a vehicle in said stall, said first and second time intervals being staggered in time by a delay, said delay and said second time interval being of a duration so that said receiving means does not detect signals reflected off of a vehicle located in an area outlying said stall;

an alarm means operatively associated with said clock and said receiving means to provide an audible warning upon the detection of a vehicle in said parking stall during said second time interval;

means for selective disarming and arming of at least one of said clock, said receiver and said alarm means to enable an authorized vehicle to occupy said parking stall without generating said audible warning, said selective means being located within said authorized vehicle.

19. A monitor for a parking stall, the stall having a first end and a second end for vehicle entry and exit, said second end being opposite said first end and spaced therefrom at least a distance equal to the length of a vehicle, comprising:

a monitor located outside said stall adjacent said first end;

means in said monitor to sense the presence of a vehicle in said stall but not in an area outlying said stall;

energy transmitting means located at said monitor for directing energy into said parking stall from said first end toward said second end;

means for receiving reflected energy from a vehicle in said parking stall, said reflected energy directed from said vehicle toward said first end;

means for providing a warning signal upon reception of said reflected energy; and means for selective disarming and arming of at least one of said energy transmission means, said means for receiving and said means for providing a warning signal, thereby to enable an authorized vehicle to occupy said parking stall without generation of said warning signal.

20. A parking stall monitor for indicating unauthorized use of a parking stall comprising:

means for detecting the presence of a vehicle in said parking stall and for providing a warning signal upon detecting said vehicle presence; and automatic means for automatic disarming and arming of said means for detecting presence and providing a warning signal, thereby to automatically enable an authorized vehicle to occupy said parking stall without a warning signal being provided, said automatic disarming and arming means being at least partially carried by said authorized vehicle.

21. A parking stall monitor for indicating unauthorized use of a parking stall comprising:

means for detecting the presence of a vehicle in said parking stall and for providing a warning signal upon detecting said vehicle presence; and passive automatic means for passive automatic disarming and arming of said means for detecting presence and providing a warning signal, thereby to passively and automatically enable an authorized vehicle to occupy said parking stall without a warning signal being provided, said passive automatic disarming and arming means being at least partially carried by said authorized vehicle.

* * * * *